US007182123B2

(12) United States Patent
Marinov

(10) Patent No.: US 7,182,123 B2
(45) Date of Patent: Feb. 27, 2007

(54) RIB AND BLOCK FOR A RADIATOR

(75) Inventor: Dobri Dimitrov Marinov, Shumen (BG)

(73) Assignee: Ficosota OOD, Shumen (BG)

( * ) Notice: Subject to any disclaimer, the term of this patent is extended or adjusted under 35 U.S.C. 154(b) by 54 days.

(21) Appl. No.: 10/533,002

(22) PCT Filed: Oct. 30, 2003

(86) PCT No.: PCT/BG03/00039

§ 371 (c)(1),
(2), (4) Date: Apr. 28, 2005

(87) PCT Pub. No.: WO2004/055461

PCT Pub. Date: Jul. 1, 2004

(65) Prior Publication Data

US 2006/0225868 A1 Oct. 12, 2006

(30) Foreign Application Priority Data

Dec. 13, 2002 (BG) ..... 107388

(51) Int. Cl.
*F28F 3/12* (2006.01)
*F24D 19/02* (2006.01)

(52) U.S. Cl. ..... 165/49; 165/152; 165/170

(58) Field of Classification Search ..... 165/49, 165/50, 53, 135, 152–153, 166, 167, 130; 392/435, 437, 377

See application file for complete search history.

(56) References Cited

U.S. PATENT DOCUMENTS 692,365 A * 2/1902 Safford ..... 165/130
787,845 A * 4/1905 Kinnear ..... 165/130
1,975,957 A * 10/1934 Kuenstler ..... 165/130
2,651,506 A * 9/1953 Lehmann ..... 165/130
4,036,287 A * 7/1977 Perani ..... 165/55
5,685,365 A * 11/1997 De'Longhi ..... 165/135
6,289,175 B1 * 9/2001 De' Longhi ..... 392/357

FOREIGN PATENT DOCUMENTS

| | | |
|---|---|---|
| DE | 2530260 | 1/1977 |
| EP | 0556433 | 8/1993 |
| EP | 0797056 | 9/1997 |
| EP | 0949460 | 10/1999 |
| EP | 0965801 | 12/1999 |
| GB | 2118706 A * | 11/1983 |

* cited by examiner

OTHER PUBLICATIONS

Search Report for PCT/BG03/00039.

*Primary Examiner*—Tho Duong
(74) *Attorney, Agent, or Firm*—Marshall, Gerstein & Borun LLP

(57) ABSTRACT

The rib and the block are applicable in heating appliances construction. They have increased operational safety and heat transfer velocity. The rib comprises an upper (1.1) and lower hole (1.2), a joining profile (2), a first (3) and second (4) internal foldings, a third intermediate (5) and a fourth external (6) folding, which ends in a fifth reversed folding (7). The fourth external folding (6) and the fifth reverse folding (7) extend from below to the end of their respective chamfers (8), and at the upper side of the rib, together with the second (4) and the third (5) folding, they connect its two vertical walls via two chamfers (9). Centrally in relation to the upper hole (1.1), on its both sides, and above, on the surface of the second internal folding 4 and the third intermediate folding (5), there are spherical concavities (10), and on both sides of the lower hole (1.2) there are similar spherical concavities (11). The radiator element (12) consists of a pair of ribs, and the radiator block consists of several such elements.

2 Claims, 5 Drawing Sheets

D-D

E-E

RIB AND BLOCK FOR A RADIATOR

REFERENCE TO RELATED APPLICATIONS

This application is the U.S. national stage, under 35 U.S.C. § 371, of International Application No. PCT/BG03/00039, having an international filing date of Oct. 30, 2003, and claims priority to Bulgaria patent application 107388, filed Dec. 13, 2002.

FIELD OF THE INVETION

The rib and the block for a radiator are applicable in the field of construction of heating appliances.

PRIOR ART

A radiator block for heating of rooms is known (EP0556433A1), which consists of many ribs, a pair of which forms a radiator element. When the block is assembled into a complete heating appliance, such as a radiator, there is hot liquid inside the radiator elements, which is heated by an electric resistance heater.

Known ribs have two typical holes and one typical joining profile, as well as a first folding and a second folding for decreasing the heating of the external peripheral surface of the radiator and for simultaneous increase of the heat-transfer efficiency. The ribs have a third intermediate and a fourth external folding, which ends in a reversed fifth folding. The various foldings of the two ribs, forming the radiator element, separate a channel-like section which decreases the temperature of the block surface and especially of the surfaces formed by the external foldings. The five foldings serve to avoid the formation of sharp edges in the slots of the obtained external surface.

The block of known ribs (EP0556433A1) is provided with a lateral external surface, which is absolutely flat. During operation its safety temperature is lowered, which ensures safety in case it is touched during exploitation.

A disadvantage of the known rib is the existence of two unsafe zones in the upper and lower part of each rib, respectively of the whole block, due to the vertically opened channels formed in the rib. A series of dangerous for the user sharp edges exist in the lower unsafe zone and the users might be wounded in case of contact with them. The open channel in the upper unsafe zone, and in particular, the surface of the heat-conducting channel, where the temperature is highest, may easily be reached by hand, especially of a child. Such contact causes painful and harmful burnings of the body. Thus, it is necessary to add a second lid to the assembly of the heating appliance. However, in this way the convection inside the block is disrupted. In order to overcome this disruption the lid is provided with holes which are as large as possible, but the danger of uncontrolled access of children's hands to the surface of the heat-conducting channel is not completely eliminated. Due to all of the above, the safety and the velocity of heat transfer of the known radiator rib and block are decreased. Because of the strict rules according to the accepted standards for the surface temperature, the enlargement of the heat transfer surface is connected with the enlargement of the dimensions of the known rib, and respectively, of the radiator block, which leads to consumption of more materials, increase of weight, inconvenience in exploitation, and as a final result, to increase of its cost.

The object of the present invention is to provide a rib and a block for a radiator with increased operational safety and heat transfer velocity and with a reduced consumption of materials.

TECHNICAL DESCRIPTION OF THE INVENTION

This object is achieved by providing a rib consisting of a typical upper hole, a typical lower hole and a typical joining profile, as well as a first and a second internal folding, a third intermediate and a fourth external folding, which ends in a reversed fifth folding. The fourth external folding and the fifth reverse folding extend from below to the end of their respective chamfers, and at the upper side of the rib, together with the second and the third folding, they connect its two vertical walls by means of two chamfers. Centrally in relation to the upper hole, on its both sides, and above, on the surface of the second internal folding and the third intermediate folding, there are spherical concavities, and on both sides of the lower hole there are similar spherical concavities.

A second radiator block is also provided and it consists of N radiator elements, each formed by a pair of ribs, which are the same as the ribs described above.

The advantage of the rib and the block for radiators is that they have increased operational safety and heat transfer velocity.

Another advantage is that the rib has a simplified technology of producing and reduced material consumption.

DESCRIPTION OF THE ENCLOSED FIGURES

The present invention is described in more detail through an embodiment shown in the accompanying figures, wherein.

EXAMPLE OF CARRYING OUT AND OPERATION OF THE INVENTION

Figures 1, 2, 3:
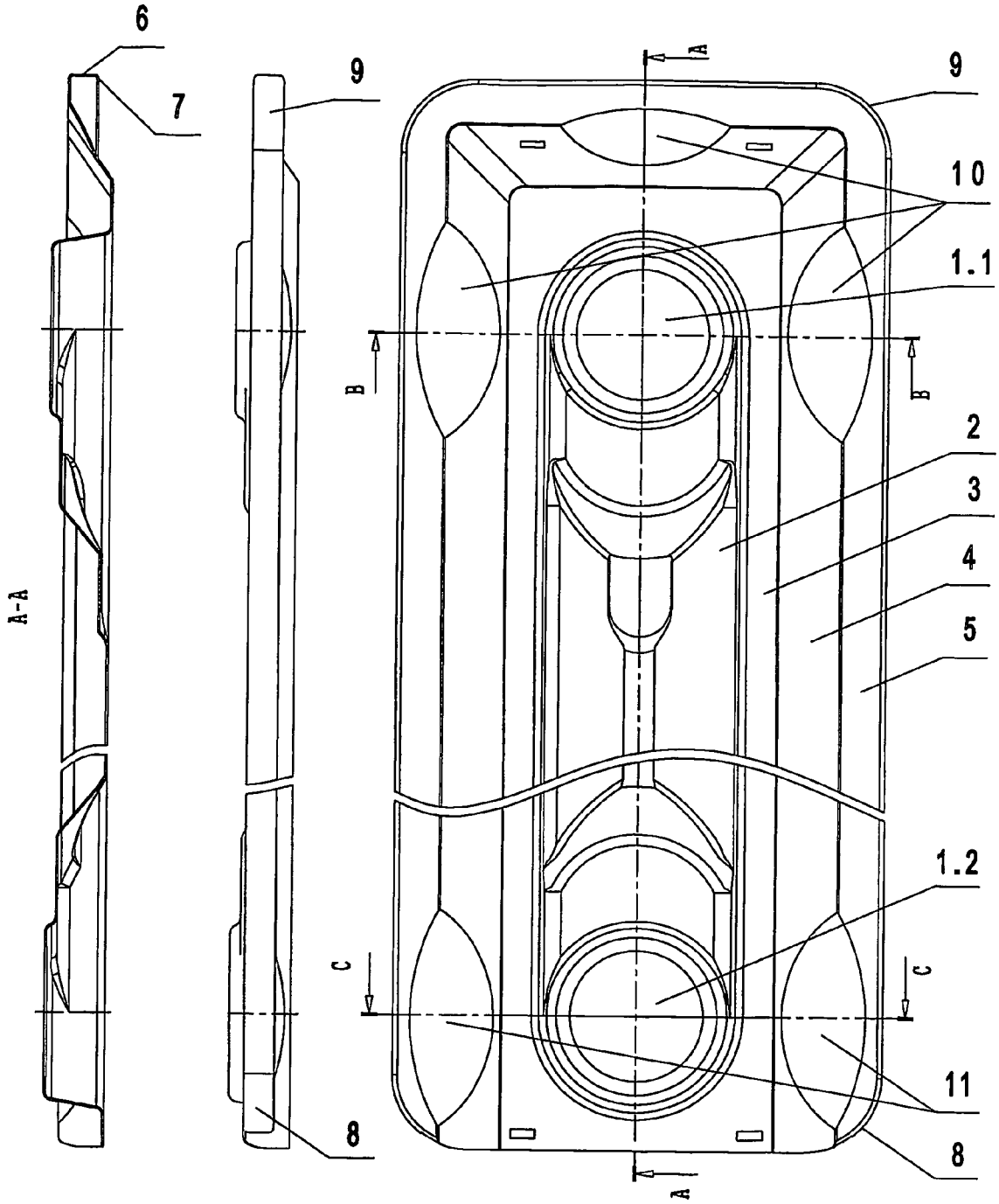
FIG. 1 is a front view of the rib from outside.
FIG. 2 is a sectional view of the rib along its longitudinal axis AA.
FIG. 3 is a side view of the rib.
Figure 7:
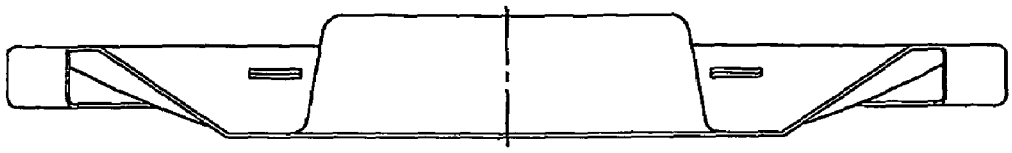
FIG. 7 is a view of the rib from below.
Figure 6:
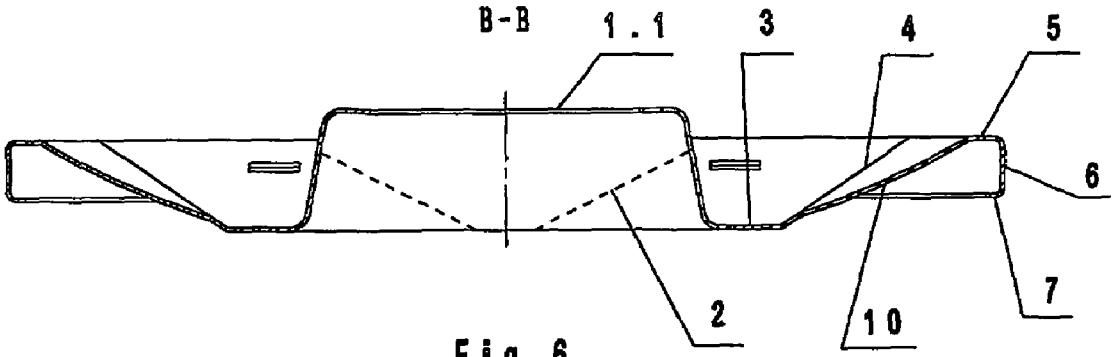
FIG. 6 is a section of the rib along the axis BB.
Figure 5:
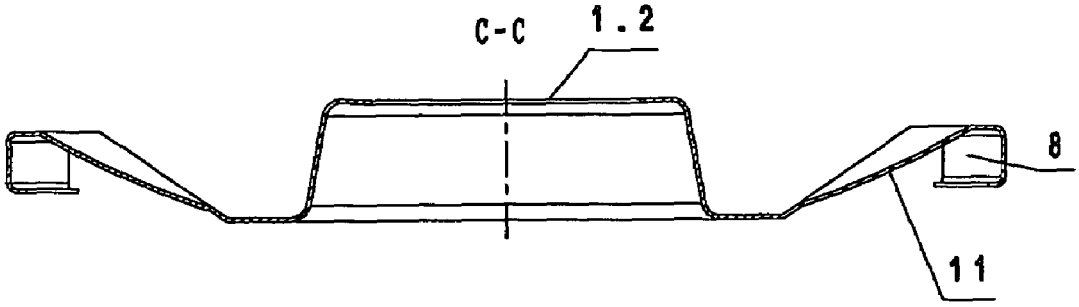
FIG. 5 is a section of the rib along the axis CC.
Figure 4:
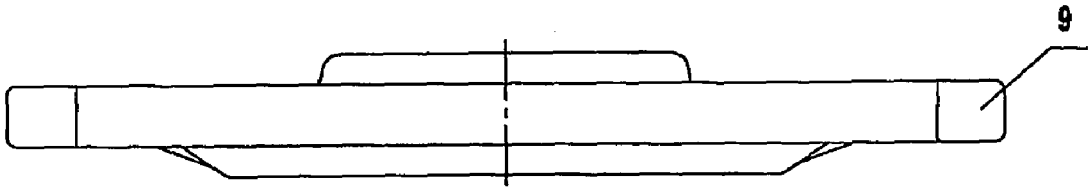
FIG. 4 is a view of the rib from above.
Figure 8:
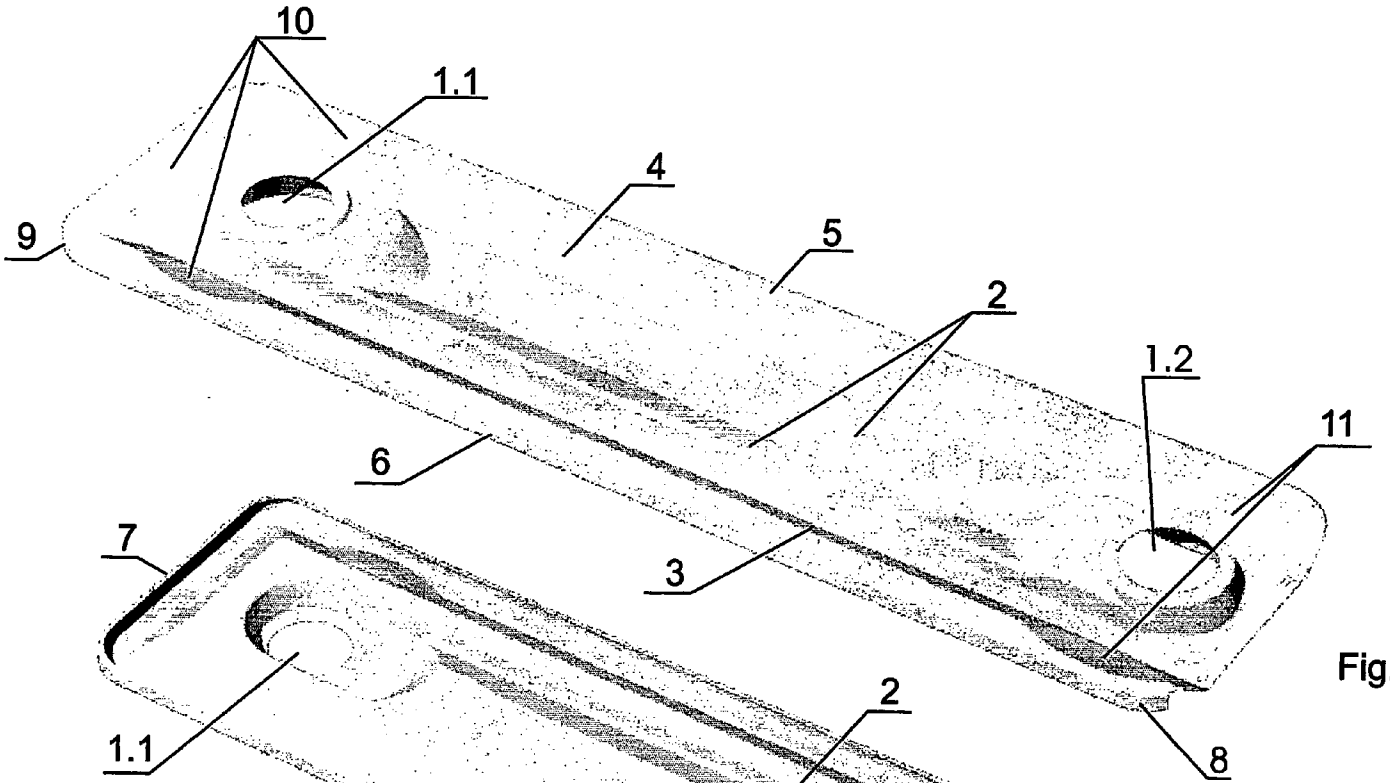
FIG. 8 is an axonometric view of the rib from outside.
Figure 9:
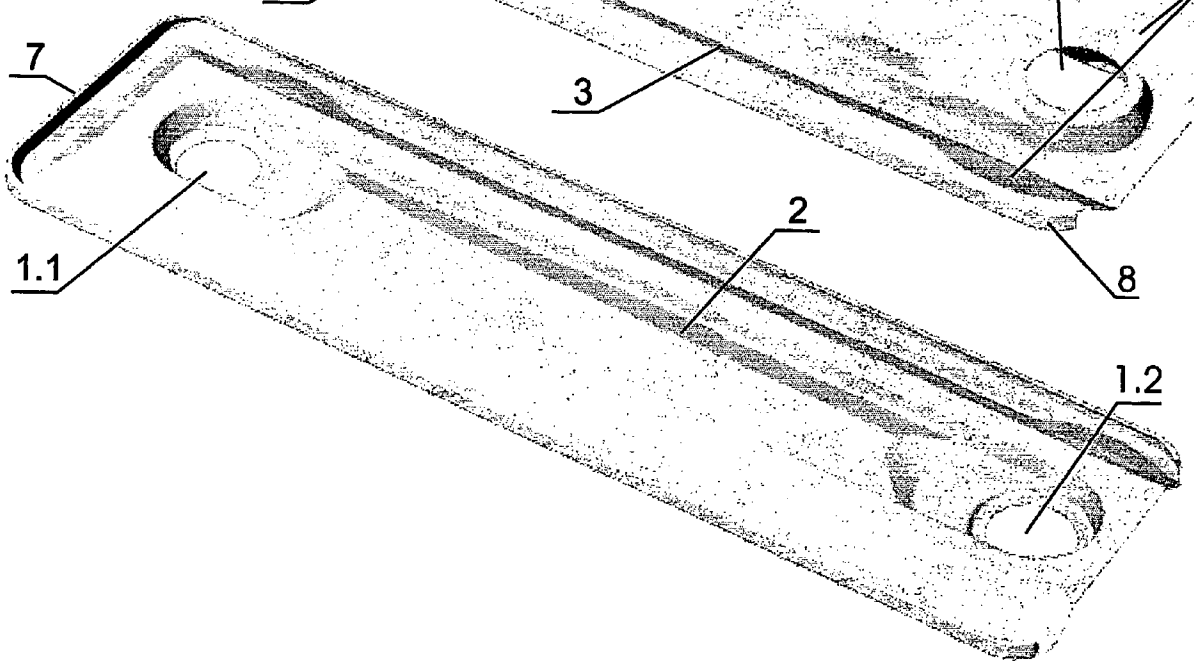
FIG. 9 is an axonometric view of the rib from inside.

The rib shown on FIG. 1 to FIG. 9 comprises a typical upper hole 1.1, a typical lower hole 1.2 and a typical joining profile 2, as well as a first internal folding 3 and a second 4 internal folding, a third intermediate 5 and a fourth external 6 folding, which ends in a fifth reversed folding 7. The fourth external folding 6 and the fifth reverse folding 7 extend from below to the end of their respective chamfers 8, and at the upper side of the rib, together with the second 4 and third 5 folding, they connect its two vertical walls by means of two chamfers 9. Centrally in relation to the upper hole 1.1, on its both sides, and above, on the surface of the second internal folding 4 and the third intermediate folding 5, there are spherical concavities 10, and on both sides of the lower hole 1.2 there are similar spherical concavities 11.

Figure 10:
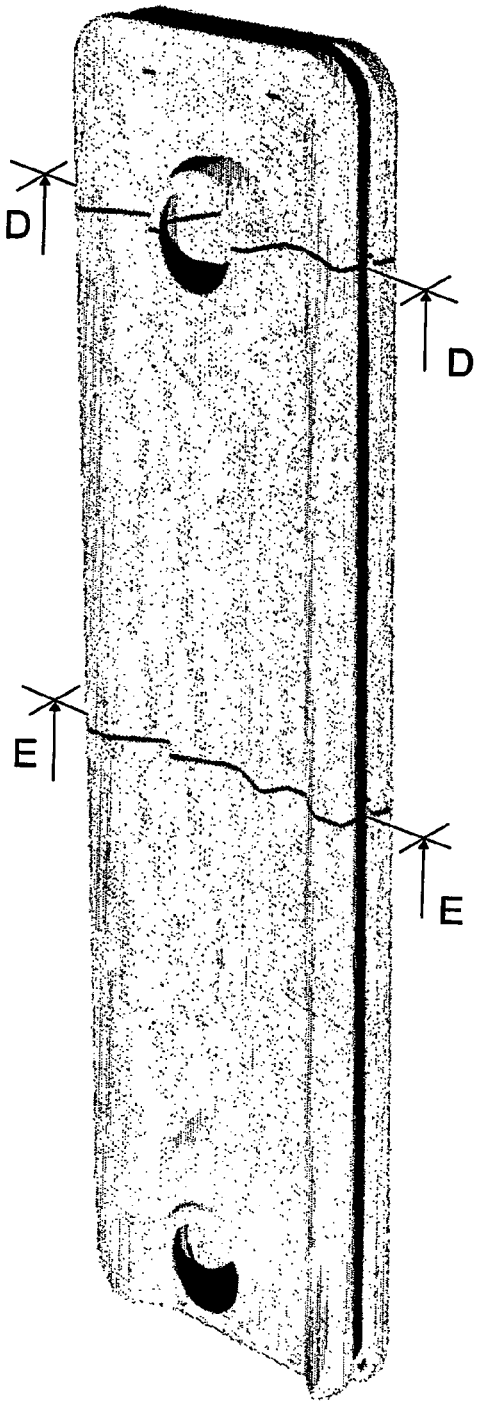
FIG. 10 is an axonometric view of the radiator element.
Figure 11:
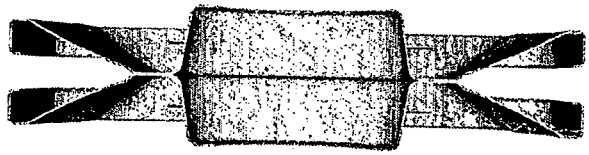
FIG. 11 is a cross-sectional view of the radiator element along the axis DD.
Figure 12:
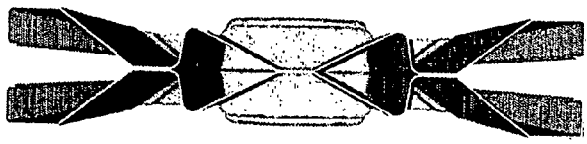
FIG. 12 is a cross-sectional view of the radiator element along the axis EE.

The radiator element 12 shown on FIG. 10 to FIG. 12 is formed by a pair of ribs, which are the same as the rib shown on FIG. 1.

Figure 13:
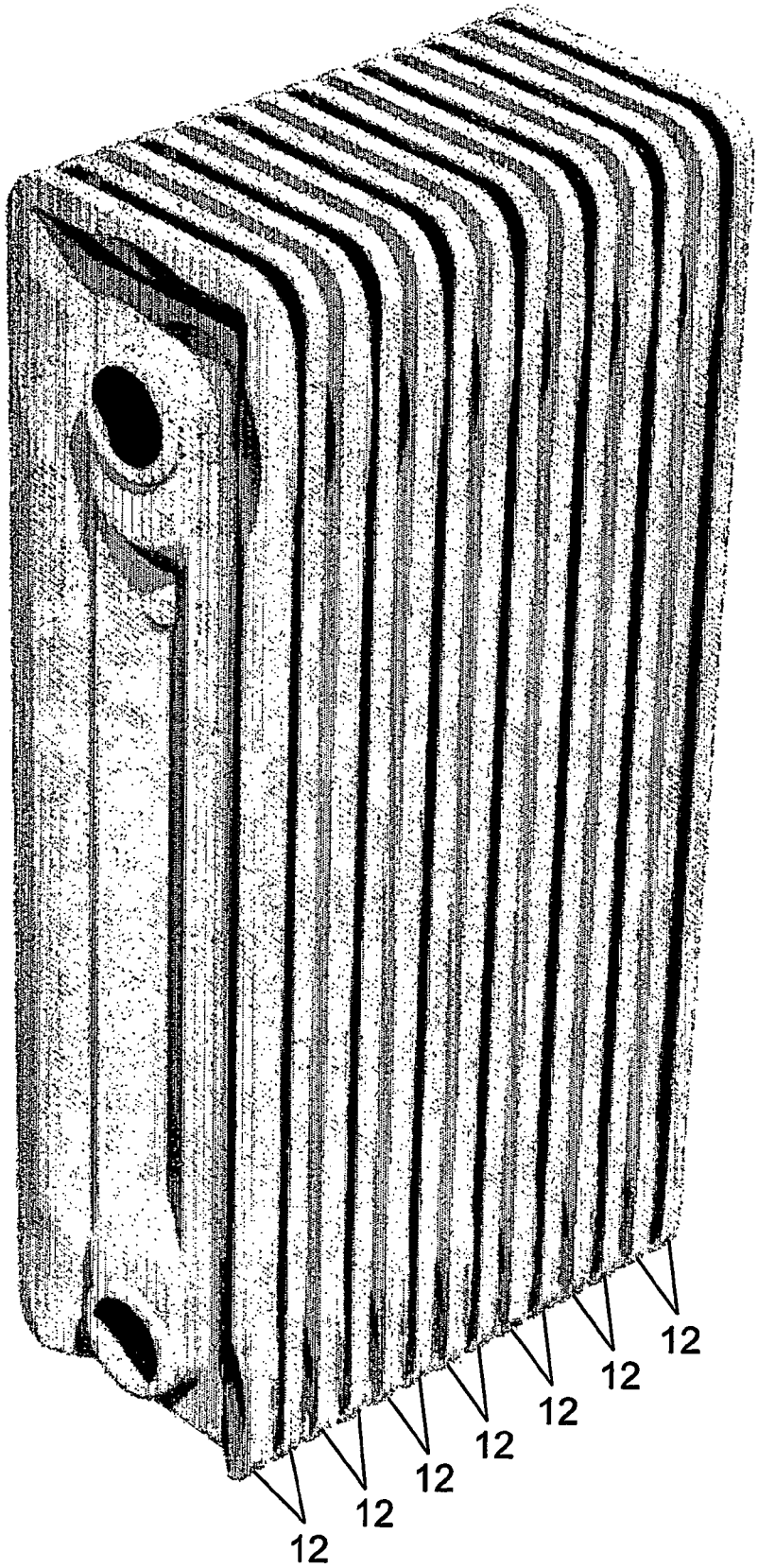
FIG. 13 is an axonometric view of the radiator block.

The radiator block shown on FIG. 13 consists of N radiator elements, such as the radiator elements shown on FIG. 10.

The rib (shown on FIGS. 1–9) is produced with die-stamping tools by means of cold drawing and cutting of the holes 1.1 and 1.2, as well as cutting of the external contour through consecutive operations until the rib takes up its final completed form, such as the form shown on the figures. The radiator element (FIGS. 10, 11, 12) consists of two ribs, exactly fixed opposite one another, thus forming two sticking zones. The first sticking zone is in the middle of the typical joining profile 2, and the second zone is along the folding 3.

Two consecutive welding operations are performed in order to connect the two ribs. The first operation is spot welding performed in the middle of the typical profile 2. The second operation consists of applying a roll-welding seam along the contour of the typical profile 2 within the space of the folding 3. Thus, closure of the volume, formed between the two opposite typical profiles 2 of the pair of ribs, is achieved (FIG. 12). The spherical concavities 10 and 11 provide the necessary space for the passage of a welding roll, whose diameter is such that it ensures the necessary resource for mass production. The edges formed at the transitions between the spherical concavities 10 and 11 and the foldings 4 and 5 strengthen the structure of the rib.

The radiator block (FIG. 13) is assembled by welding the radiator elements within the zone surrounding the typical holes 1.1 and 1.2, thus achieving a uniform hermetically sealed volume in which the heat transferring fluid flows (not shown on figures).

This volume is arbitrarily separated into three zones. The first zone extends along the axis of the holes 1.1. The second zone encompasses the spaces, closed by the typical joining profiles 2 of all radiator elements. The third zone encompasses the space along the axis of the holes 1.2. The heat transferring fluid takes up the volume of the second and the third zone and reaches up to the level of the first zone. An electric resistance heating element (not shown on the figures) is also arranged in the third zone and it heats up the heat transferring fluid. As a result, the heat transferring fluid expands and this expansion is received in the volume of the first zone (along the axis of the holes 1.1).

In this way each heating radiator consisting of the ribs, respectively, of the block according to the invention is able to transfer a maximum quantity of heat. This is due to the achieved provision of high temperature over a large heating and heat-transfer surface of the block. The high surface temperature is dangerous for the users, but the rib, respectively, the block provide the possibility of circulation of the hot heat-transferring fluid only within the radiator elements. Thus, the heat is transferred to the walls of the channels, formed by the typical joining profiles 2, opposite to one another, which for their part consequently transfer heat to foldings 3, 4, 5, 6, 7. The air particles that are in direct contact with the hot foldings surfaces get heated, and then, through convection, they transport the absorbed heat into the room. As it is shown on FIG. 12, the typical joining profile and the folding 3 transfer heat to the surrounding environment with their external surfaces, whereas the foldings 4, 5, 6 and 7, the spherical concavities 10 and 11 and the chamfers 8 and 9 transfer the heat with their both surfaces. In this way the overall heat-transferring surface is considerably increased and the temperature of the folding 6, external to the radiator block, is decreased. It is namely the folding 6 that is accessible for touching, but due to the intensive heat transfer, its temperature is not dangerous for humans. On the other hand, the oppositely arranged foldings 4, 5, 6, 7 of the radiator elements form consecutively arranged vertical structures, thus increasing the convection (chimney effect). In this manner, the radiator block ensures the free penetration of cold air into its lower part as well as the leakage of the heated air through the slots formed by the opposing foldings 7 in the radiator elements and the opposing foldings 5 between the adjacent radiator elements. In this way, concentration of high temperatures inside the radiator block is achieved, and in particular, in the field of the typical profile 2 and the folding 3. Also, the heat transfer is increased thanks to the two heat transferring sides of the foldings 4, 5, 6, 7 and the vertical structures, which increase the convective flows. The temperature of the surface of the folding 6 is lower.

The radiator block has a uniform flat lateral and upper surface, formed by the consecutively repeating foldings 6 of the ribs, connected in their upper ends with the chamfer 9 and ending at their lower ends with the chamfer 8, furrowed by the slots formed by the distances between the foldings 7 in the radiator element and the distances between the foldings 5 of two adjacent radiator elements, whereas both distances are equal. As it is shown on FIG. 11, all edges of the slots are rounded, especially in the transition point between the folding 5 and 6, and in the transition point between the folding 6 and 7. This provides safety in case of touching because the size of the slots does not allow the penetration of a hand, including a child's hand, to the hot internal surfaces. At the same time, the free movement of airflow is not restricted. The design of the rib and the radiator element is such that a finished construction of a radiator block is obtained only through multiplication of the rib, without any need of additional elements, such as lids, screens, baffles, gratings etc. The area is increased owing to the bilateral heat transfer of the foldings 4, 5, 6 and 7, the chamfers 8 and 9, and of the channel-shaped structures. In this way, the convective flow and, as a result, the heating power, are increased, thus allowing the faster heating of the room. The flat lateral surface, formed by the foldings 6, the narrow slots, blocking the access to the internal hot zone, the chamfers 9 in the upper part of the radiator element, the chamfers 8 in the lower part of the radiator element and the low surface temperature, contribute to the safety of the radiator block.

I claim:

1. A rib comprising a typical upper hole (1.1), a typical lower hole (1.2) and a typical joining profile (2), as well as a first (3) and a second (4) internal folding, a third intermediate (5) and a fourth external folding (6), ending in a fifth reversed folding (7), characterised in that the fourth external folding (6) and the fifth reversed folding (7) extend on both opposite vertical sides of the rib, to the lower part of the rib where they end with two chamfers (8) on each opposite lower corner of the rib, and the third intermediate folding (5), the fourth external folding (6) and the fifth reversed folding (7) extend on the upper part of the rib to connect two vertical walls of the rib and form two chamfers (9) located on both opposite upper corners of the rib, wherein centrally in relation to the upper hole (1.1), on its both sides, and above, on the surfaces of the second internal folding (4) and the third intermediate folding (5) there are three spherical concavities (10), and on both sides of the lower hole (1.2) there are two similar spherical concavities (11).

2. A block for a radiator consisting of N radiator elements (12), each formed by a pair of ribs, characterised in that the ribs are designed according to claim 1.

* * * * *